US006722749B1

(12) United States Patent
Pagac

(10) Patent No.: US 6,722,749 B1
(45) Date of Patent: Apr. 20, 2004

(54) DRAWER OPEN POSITION CONTROLLER

(75) Inventor: William T. Pagac, Kenosha, WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 6 days.

(21) Appl. No.: 09/929,162

(22) Filed: Aug. 14, 2001

(51) Int. Cl.[7] ..... E05C 7/06
(52) U.S. Cl. ..... 312/221; 312/218
(58) Field of Search ..... 312/216, 217, 312/218, 221, 222, 215, 107.5, 330.1

(56) References Cited

U.S. PATENT DOCUMENTS

| | | | | | |
|---|---|---|---|---|---|
| 1,307,581 | A | * | 6/1919 | Gale | 312/222 |
| 2,886,392 | A | * | 5/1959 | Stegmaier | 312/217 |
| 3,404,929 | A | | 10/1968 | Wright et al. | |
| RE26,902 | E | | 5/1970 | Levenberg | |
| 3,589,783 | A | * | 6/1971 | Studinski et al. | 312/127 |
| 3,874,755 | A | | 4/1975 | Hegg et al. | |
| 3,881,793 | A | * | 5/1975 | Anderson | 312/217 |
| 3,883,199 | A | | 5/1975 | Crawley, Jr. et al. | |
| 3,888,558 | A | | 6/1975 | Himsl | |
| 4,298,236 | A | | 11/1981 | Laroche | |
| 4,425,013 | A | * | 1/1984 | Killen | 312/216 |
| 4,609,233 | A | | 9/1986 | Walla | |
| 4,637,667 | A | | 1/1987 | Reid et al. | |
| 4,865,404 | A | | 9/1989 | Harper | |
| 4,889,396 | A | | 12/1989 | Mitchell et al. | |
| 4,925,257 | A | | 5/1990 | Frederiksen et al. | |
| 4,955,672 | A | * | 9/1990 | Pham | 312/107.5 |
| 4,966,422 | A | | 10/1990 | Albright et al. | |
| 5,040,858 | A | | 8/1991 | Kruse et al. | |

(List continued on next page.)

FOREIGN PATENT DOCUMENTS

| | | |
|---|---|---|
| DE | 2916245 | 11/1980 |
| DE | 3633256 | 3/1988 |
| DE | 3818610 | 8/1989 |
| DE | 4004724 | 5/1991 |
| EP | 639687 | 2/1995 |
| GB | 2 096 229 A | 4/1981 |
| GB | 2095322 | 9/1982 |
| GB | 2170993 | 8/1986 |
| GB | 2 297 800 A | 8/1996 |

OTHER PUBLICATIONS

Accuride® Model 3600 Specification Sheets (2) 1998.
U.S. patent application Ser. No. 09/867,823, inventor: Slivon, filed: May 30, 2001, "Multiple Drawer Cabinet Allowing One Drawer Opened at a Time".

*Primary Examiner*—Janet M. Wilkens
(74) *Attorney, Agent, or Firm*—Seyfarth Shaw LLP

(57) ABSTRACT

A multi-drawer device includes a first drawer and a second drawer, each carried by a housing, and movable between a closed position disposed within a housing and an open position extending from the housing. A first slide assembly couples the first drawer to the housing and a second slide assembly couples the second drawer to the housing. A ramp and follower are each associated with the first drawer and the follower is adapted to contact and slide along the ramp. A first blocking device is associated with the second drawer and coupled to one of the ramp and the follower. The ramp, the follower and the blocking device all cooperate such that as the first drawer moves from the closed position toward the open position, the follower contacts and slides along the ramp, for moving the blocking device into a blocking position that interferes with the second drawer, when the second drawer is in a predetermined partially open position, to prevent the second drawer from moving to the fully open positions, but still allow access to the second drawer.

24 Claims, 20 Drawing Sheets

U.S. PATENT DOCUMENTS

| | | | |
|---|---|---|---|
| 5,056,877 | A | 10/1991 | Westwinkel |
| 5,172,967 | A | 12/1992 | Pipe |
| 5,352,030 | A | 10/1994 | Derle et al. |
| 5,387,032 | A | 2/1995 | Reisbeck |
| 5,599,077 | A | 2/1997 | Law et al. |
| 5,599,078 | A | 2/1997 | Dechene et al. |
| 5,605,388 | A | 2/1997 | Laakso |
| 5,634,701 | A | 6/1997 | Hendrich et al. |
| 5,671,985 | A | 9/1997 | Grieser et al. |
| 5,829,859 | A | 11/1998 | Cram |
| 5,855,423 | A | 1/1999 | Cram |
| 5,997,114 | A | 12/1999 | Bischoff |
| 6,238,024 | B1 | 5/2001 | Sawatzky |
| 6,254,205 | B1 | 7/2001 | Wright et al. |
| 6,296,332 | B1 | 10/2001 | Lammens |

* cited by examiner

10

DRAWER OPEN POSITION CONTROLLER

BACKGROUND OF THE INVENTION

The following disclosure relates to devices having multiple drawers. The following disclosure has particular application to apparatus and methods for preventing a second drawer from being fully opened in a multi-drawer device, such as a cabinet or the like, when a first drawer has been opened beyond a predetermined amount.

Various types of multi-drawer devices are provided with mechanisms to prevent the device from tipping over. However, many prior designs prevent access to other drawers after a first drawer has been moved toward an open position. Examples of such multi-drawer devices are shown in U.S. Pat. Nos. 3,404,929; 3,874,755; 3,883,199; 3,888,558; 4,298,236; 4,609,233; 4,637,667; 4,889,396; 4,925,257; 4,966,422; 5,040,858; 5,387,032; 5,599,077; 5,599,078; 5,605,388; 5,634,701; and/or 5,671,985.

Such multi-drawer devices suffer from the total denial of access to the other drawers after a first drawer is opened. While some of these designs may be perfectly adequate for some uses, they require the opened drawer to be closed in order to gain access to items stored in one of the locked doors. This can be inconvenient to the user and can result in less efficient use of the user's time.

SUMMARY OF THE INVENTION

The disclosed apparatus and methods avoid some of the disadvantageous of prior devices and methods while affording additional structural and operating advantages.

One form of the disclosed multi-drawer device comprises a plurality of drawers supported in a housing and coupled to the housing with slide assemblies. A blocking device is included that is responsive to the movement of the first drawer toward a fully opened position to interfere with a second drawer in a predetermined partially opened position, thereby preventing the second drawer from fully opening.

One form of the disclosed multi-drawer device comprises first and second drawers carried by a housing and moveable between a closed position disposed within the housing and a fully opened position extending a maximum distance from the housing. A first slide assembly couples the first drawer to the housing and a second slide assembly couples the second drawer to the housing. A ramp is associated with the first drawer and a follower, also associated with the first drawer, is adapted to contact and slide along the ramp. A blocking device is coupled to one of the ramp and the follower and is associated with the second slide assembly. The ramp, follower, and first blocking device all cooperate such that as a first drawer moves from the closed position toward the fully opened position, the follower contacts and slides along the ramp, for moving the first blocking device into a blocked position that interferes with the second slide assembly when the second drawer is in a partially opened position, thereby preventing the second drawer from moving to the fully opened position.

The disclosed multi-drawer device and locking mechanism comprises certain novel features and a combination of parts hereinafter fully described and illustrated in the accompanying drawings, it being understood that various changes in the details may be made without departing from the spirit, or sacrificing any of the advantages of the present disclosed multi-drawer device and locking mechanism.

BRIEF DESCRIPTION OF THE DRAWINGS

For the purpose of facilitating an understanding of the disclosed apparatus and method, there are illustrated in the accompanying drawings preferred embodiments thereof, from an inspection of which, when considered in connection with the following description, the disclosed apparatus and method, its construction and operation, and many of its advantages should be readily understood and appreciates.

DETAILED DESCRIPTION OF THE DRAWINGS

Figure 1:
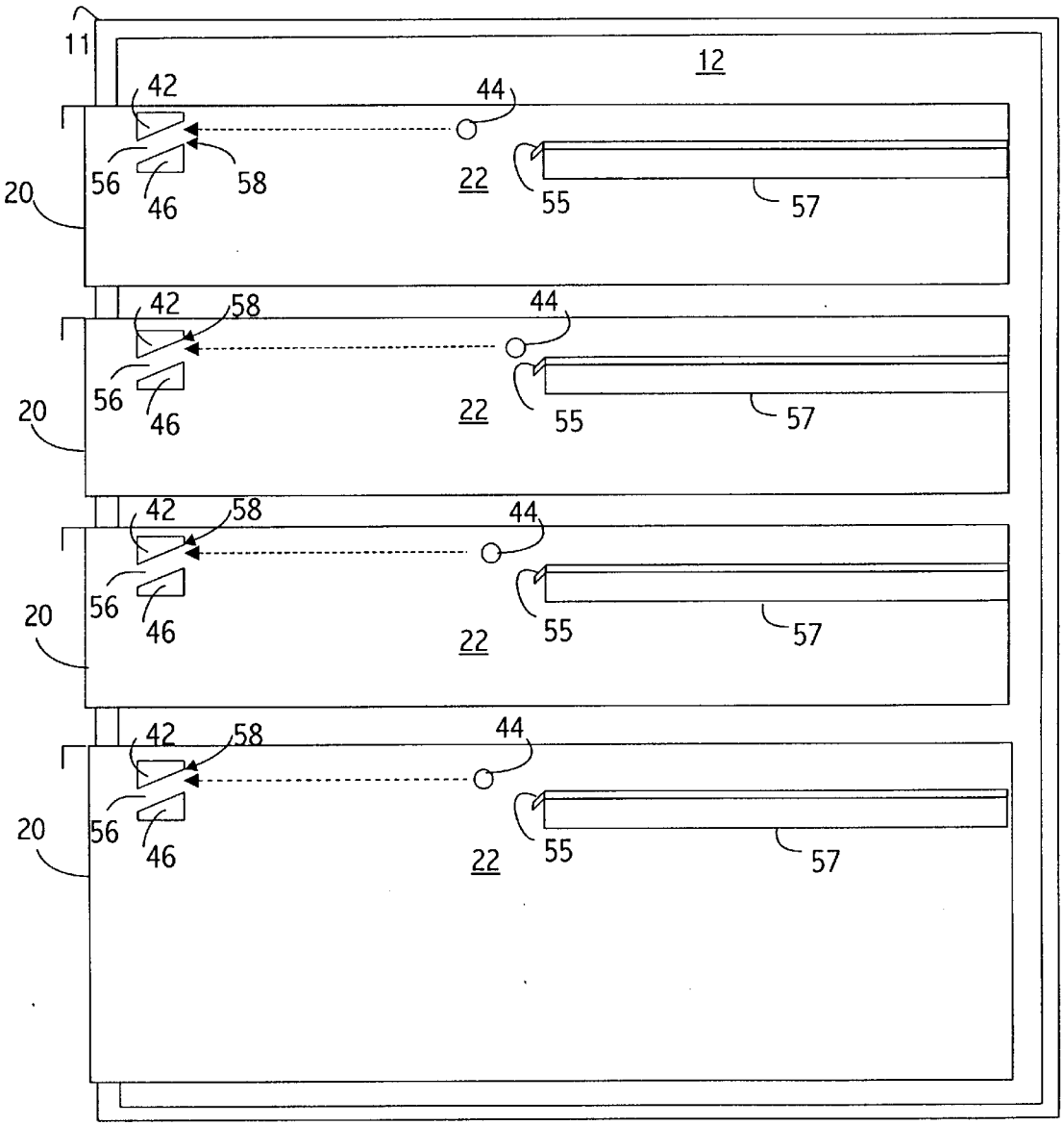
FIG. 1 is a side elevational view of a first form of multi-drawer device having a side wall and slide mechanism removed.
Figure 1A:
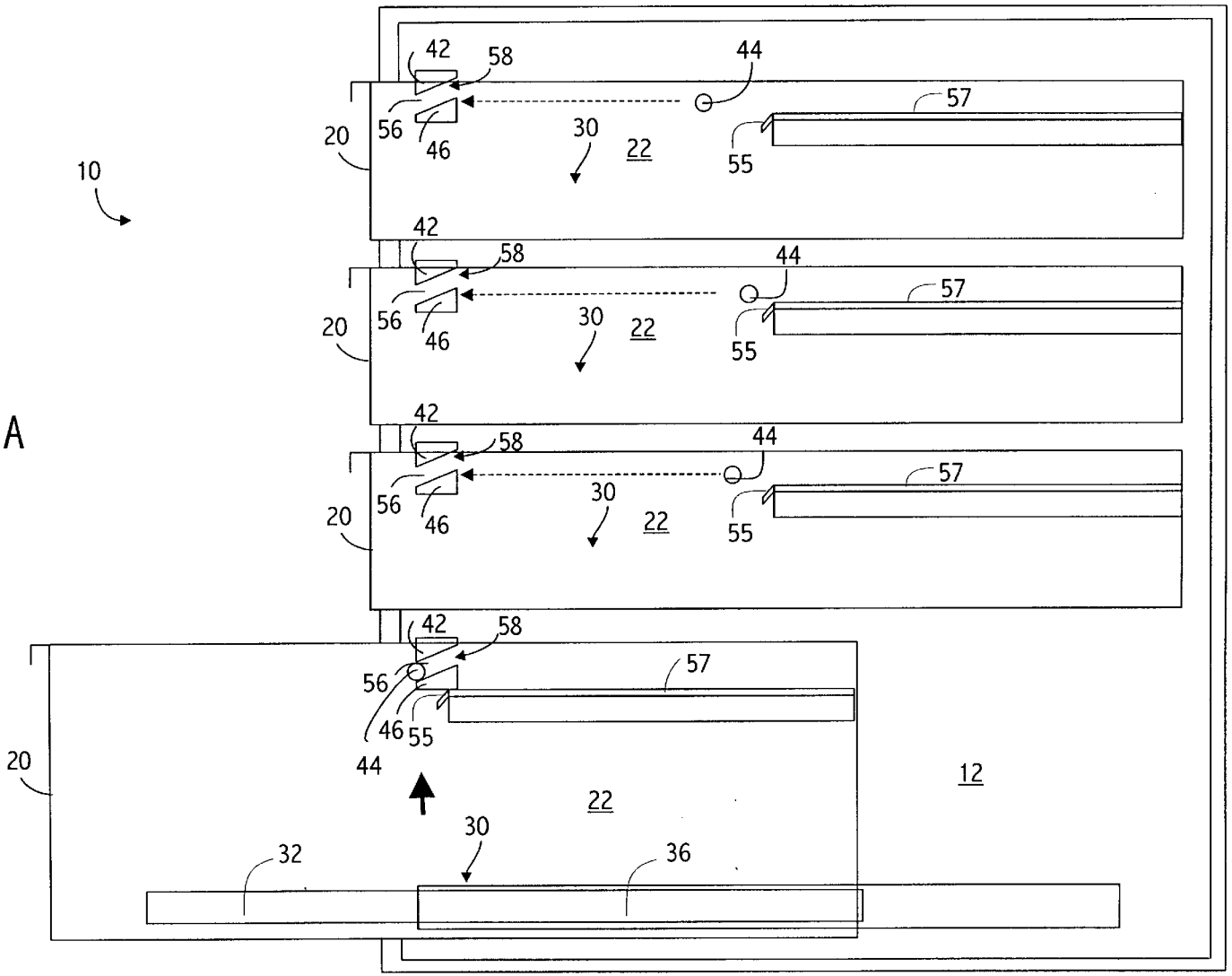
FIG. 1A is a view similar to FIG. 1 with only a portion of the slide mechanism removed and having a bottom drawer extended slightly beyond a predetermined partially opened position.
Figure 1B:
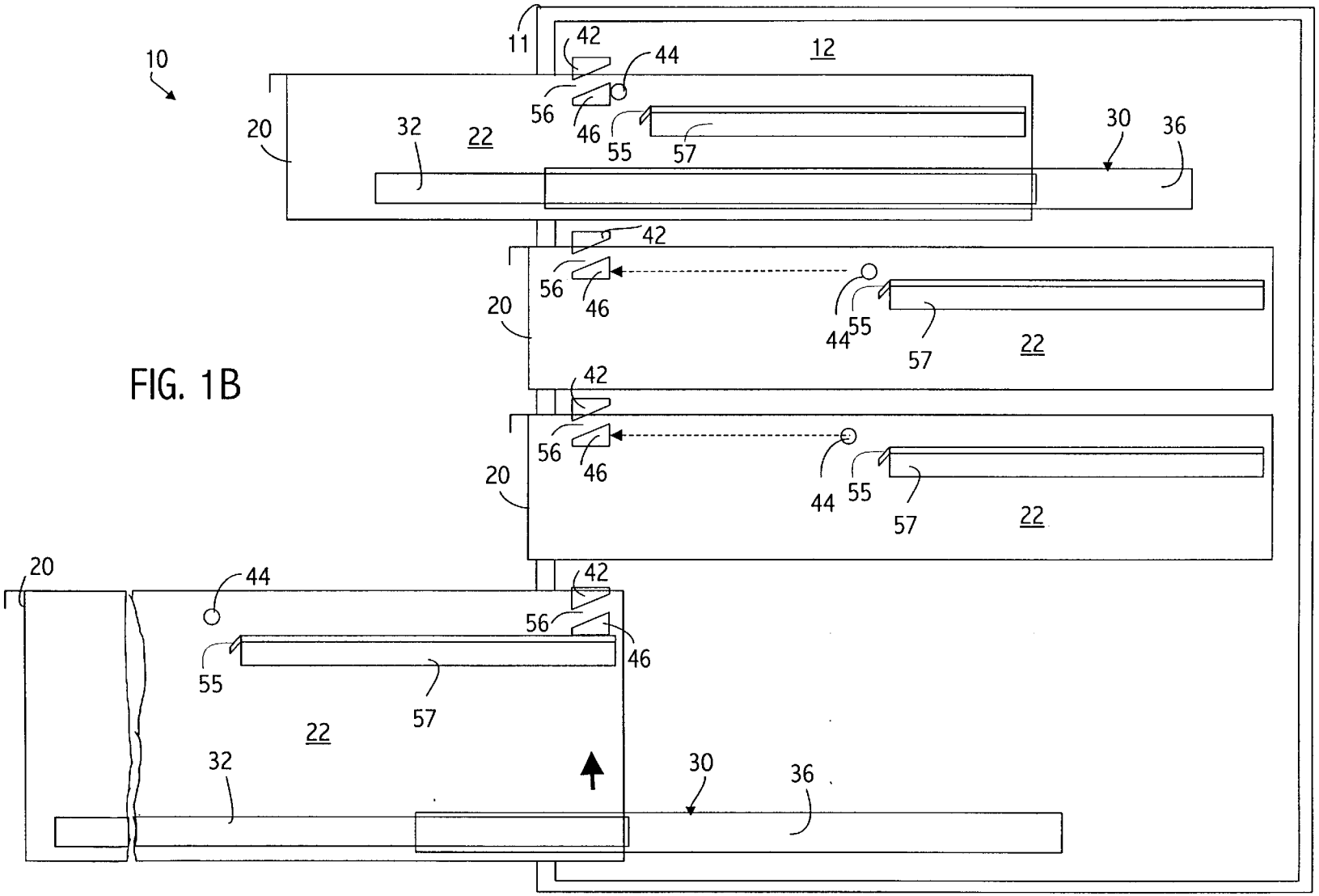
FIG. 1B is a view similar to FIG. 1A with the bottom drawer in a fully opened position and a top drawer in a predetermined partially opened position.

Referring to FIGS. 1, 1A and 1B there is illustrated a multi-drawer device 10 having a housing 11 carrying a plurality of drawers 20. Drawers 20 can have many features in common with other drawer designs. For example, drawer 20 includes two side walls 22 (one shown). A slide assembly 30 can be provided to couple drawer 20 to multi-drawer device 10. Slide assembly 30 (FIG. 1A) can be a three-member telescoping slide mechanism (similar to the one depicted in FIG. 3C) comprising a first member 32 coupled to drawer 20, for example to one of the side walls 22; a second member 34 coupled to housing 11, for example to one of two side walls 12 (one shown); and intermediate member 36 coupling first member 32 and second member 34 together. However, in FIGS. 1A–1B, second member 34 of slide assembly 30 is not depicted in order to simplify the figures.

A drawer locking assembly is provided to minimize the possibility of more than one drawer being fully opened at the same time, thereby reducing the probability of multi-drawer device 10 tipping over. The drawer locking assembly can include a ramp 42, a follower 44 and a blocking device 46. Ramp 42 and blocking device 46 form a guide 56 therebetween that is adapted to receive follower 44 and position follower 44 for movement along ramp 42. Follower 44 can be coupled to drawer 20 in any suitable spot, such as approximately midway between the front and rear ends of side wall 22 and each follower 44 can be somewhat staggered so that they are not aligned vertically above one another. This misallignment prevents more than one drawer from being fully opened by a person using two hands to try opening two different drawers in synchronization in an attempt to defeat the safety mechanism. In one form, each drawer 20 has one ramp 42, one follower 44, and one blocking device 46 associated therewith. A bar 48 (FIG. 1C) can couple each set of ramp 42 and blocking device 46 to one another. Bar 48 is slidably coupled to side wall 12 of multi-drawer device 10. In one form, a plurality of elongated openings (similar to those depicted as 50 in FIG. 6 or 51 in FIG. 7) are provided in bar 48. A fastener (similar to item 52 in FIG. 7), having a head (similar to item 54 in FIG. 7), slidably couples bar 48 (through elongated openings 50 and 51) to housing side wall 12.

Figure 6:
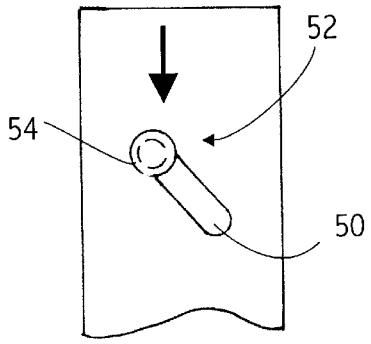
FIG. 6 is a fragmentary, side elevational view of a locking device used in a sixth form of multi-drawer device.
Figure 6:
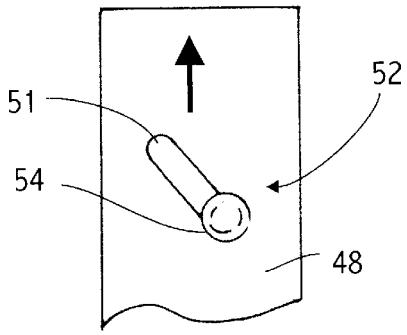
Figure 6:
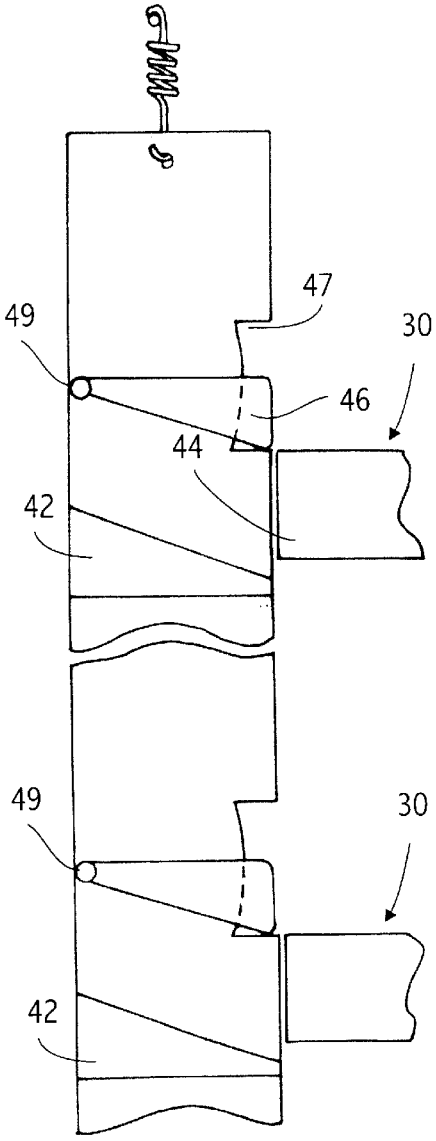
Figure 7:
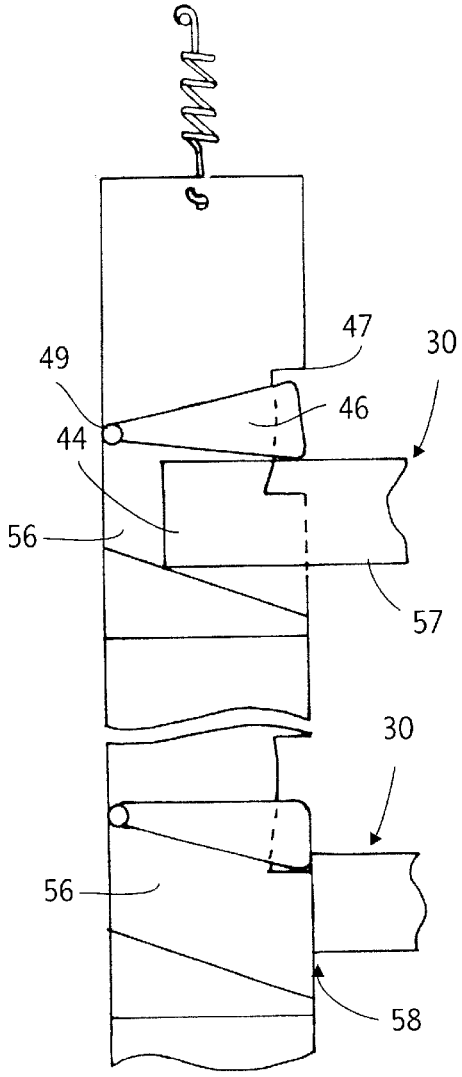
FIG. 7 is a view similar to FIG. 6 with the locking device in a position when one of the drawers is extended just beyond a predetermined partially opened position.

Such elongated openings (50 or 51) can be in a vertical direction that allows fastener 52 to slidably couple bar 48, through elongated openings 50 and 51, to housing side wall 12 so that bar 48 is slidable in a vertical direction. Alternatively, slots 50 or 51 can have a positive or negative incline with respect to the horizon, as depicted in FIG. 6 or 7, to allow bar 48 to slide in a direction having both a vertical and a horizontal component.

Ramp 42, blocking device 46, and bar 48 can all have a small profile that readily fits between drawer side wall 22 and the nearer of the two side walls 12 of multi-drawer device 10. In one form, ramp 42, blocking device 46 and bar 48 can fit between a drawer side wall 22 and intermediate member 36 of slide assembly 30.

A slide assembly 30 can be provided for each drawer side wall 22. In this case, one drawer locking assembly can also be provided on each side wall 12 of multi-drawer device 10. Alternatively, it is possible that only one drawer locking assembly would be provided, even where two slide assemblies 30 are used. However, two drawer locking assemblies will keep the drawers more secure.

Figure 1C:
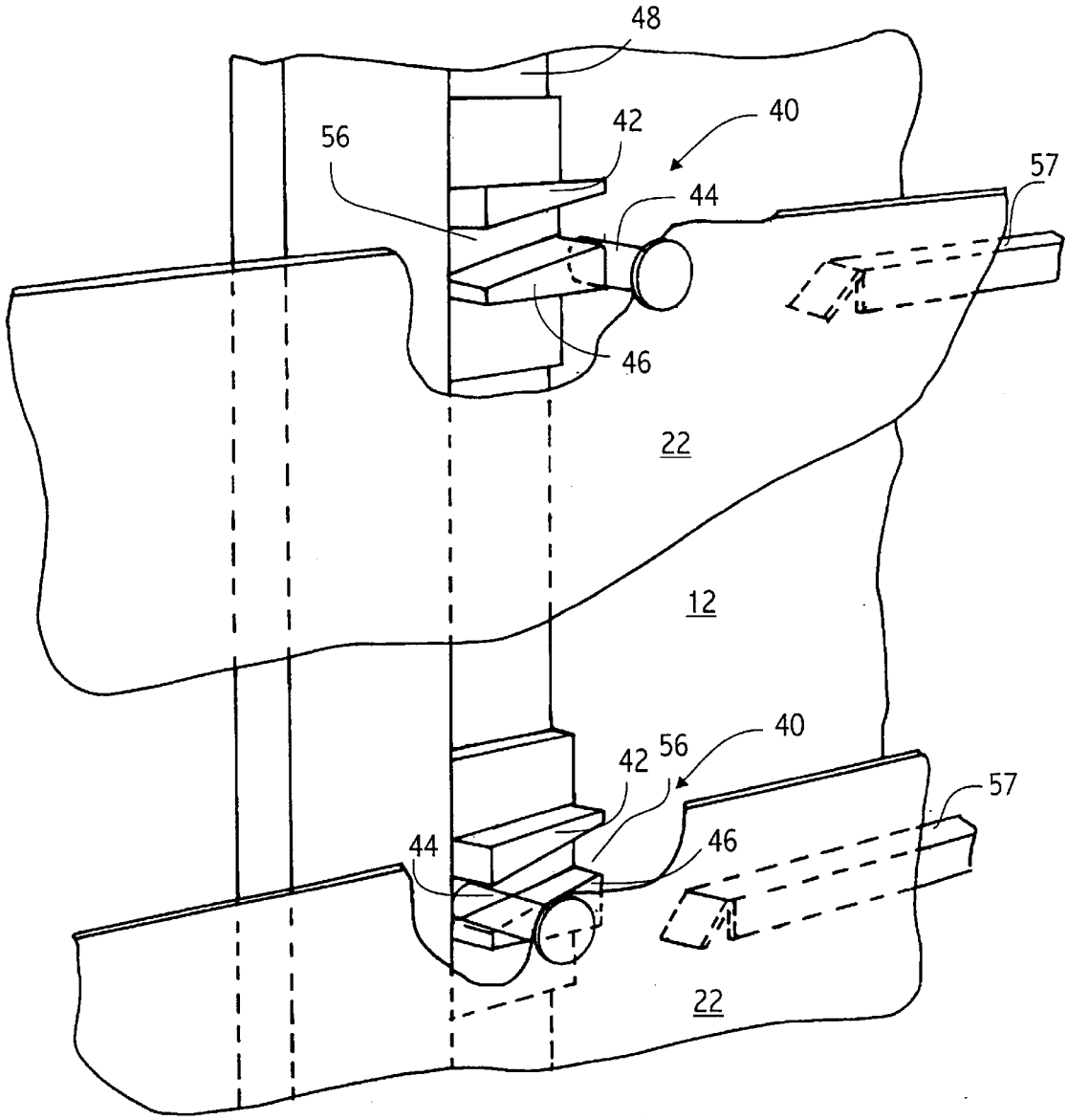
FIG. 1C is an enlarged, fragmentary, perspective view of a portion of the multi-drawer device of FIG. 1B.
Figure 1C:
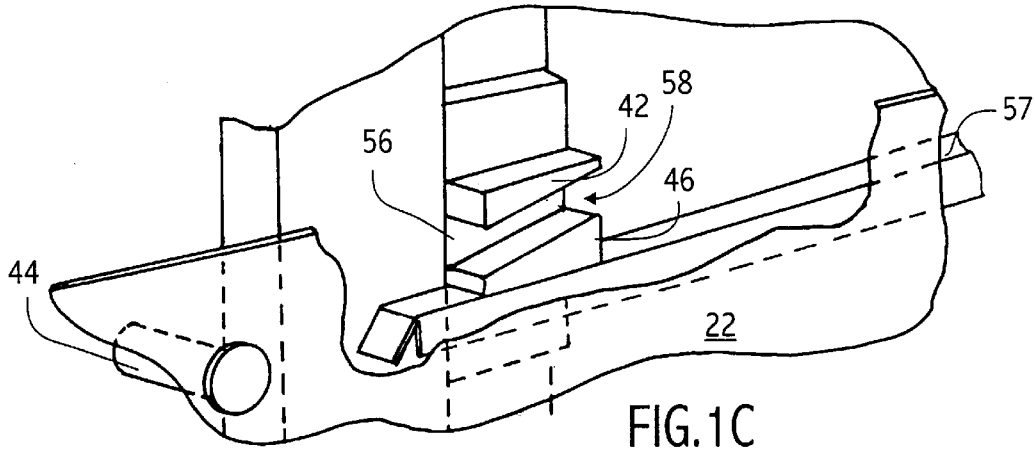

In use, gravity or another force, such as a spring (not shown), biases bar 48, and thus ramp 42 and blocking device 46, downward, as shown in FIG. 1. When all drawers 20 are in a closed position, follower 44 is aligned with the leading end 58 of guide 56 (see FIG. 1). As one of drawers 20 moves from the closed position to the open position, follower 44 enters leading edge 58 of guide 56 and contacts ramp 42. As drawer 20 is pulled further open, follower 44 moves along guide 56 and slides along ramp 42 causing ramp 42, bar 48 and locking device 46, to move opposite the direction of the biasing force, as shown in FIGS. 1A, 1B, and 1C. Follower 44 causes ramp 42 and bar 48 to raise, thereby raising the blocking devices 46 associated with the still-closed drawers 20, such that each blocking device 46 raises in front of a follower 44 of its associated closed drawer into a locked position (seen in FIGS. 1A, 1B, and 1C), thereby interfering with follower 44 when the previously closed drawer 20 is in a predetermined partially open position. This prevents the previously closed drawer 20 from moving to the fully open position while still providing access to the previously closed drawer 20.

As follower 44 exits guide 56, a support assembly maintains bar 48 in the locked position (shown in FIGS. 1A, 1B, and 1C). In one form, support assembly comprises support 57 and the blocking device 46 that are associated with the open drawer 20. Ramp 42 and blocking device 46 protrude from bar 48 and blocking device 46 is adapted to be supported and retained by support 57 before, or as, follower 44 exits guide 56 when drawer 20 is opened. As drawer 20 is opened, blocking device 46 is retained by support 57 and keeps bar 48, and thus the rest of blocking devices 46, in the locked position shown in FIGS. 1A, 1B, and 1C.

In one form, support 57 comprises a horizontal surface extending out from drawer sidewall 22, as shown in FIG. 1*c*. Support 57 can be a bracket having an L-shaped cross section, as shown in FIG. 1*c*, or can comprise a lanced out or bulged out portion of drawer sidewall 22. Furthermore, support 57 can include lead ramp 55 at the end that first encounters blocking device 46 as the drawer is opened. This allows blocking device 46 to slide along ramp 55 if blocking device 46 is not aligned with the rest of support 57. Lead ramp 55 allows for a more robust design of multi-drawer device 10 by requiring less accuracy and tolerance in the manufacturing process.

From a comparison of FIGS. 1A and 1B, it is apparent that the follower 44, associated with the drawer 20 being moved to the fully open portion, contacts and slides along ramp 42 when such drawer 20 is in a predetermined partially open position.

As drawer 20 is moved towards the closed position, ramp 42 and blocking device 46 slide off of support 57 and follower 44 enters guide 56. As drawer 20 is closed, bar 48 is biased downward by ramp 42 until bar 48 and blocking devices 46 are in an unlocked position, as shown in FIG. 1.

While blocking device 46 has been shown as part as the support assembly, alternatively a separate protrusion (not shown) of bar 48 could be provided to be retained and be supported by support 57. Alternatively, ramp 42 could comprise part of the support assembly and be retained and supported by support 57. Additionally, one of ordinary skill in the art will also recognize that a spring or other device could be used to bias bar 48 upwards and the configuration of ramp 42 and blocking device 46 can be altered so that follower 44 contacts ramp 42 and causes ramp 42, bar 48 and blocking device 46 to move downward.

Other forms of multi-drawer device can be used to prevent a selected second drawer from opening after a first drawer is opened. In one such form, a blocking device might not be associated with each of drawers, thereby allowing selected drawers to be fully opened even after a first drawer has been opened. Additionally, a ramp, a follower, and a supporting device might not be provided for all drawers so that the opening of selected drawers would not cause any others to lock. This alternative form is especially useful for multi-drawer devices having different-sized drawer or drawers designed to carry different weights. In such a device, it may be acceptable to allow one or more small drawers to be in a fully open position even if another drawer is in a fully open position.

Figure 5:
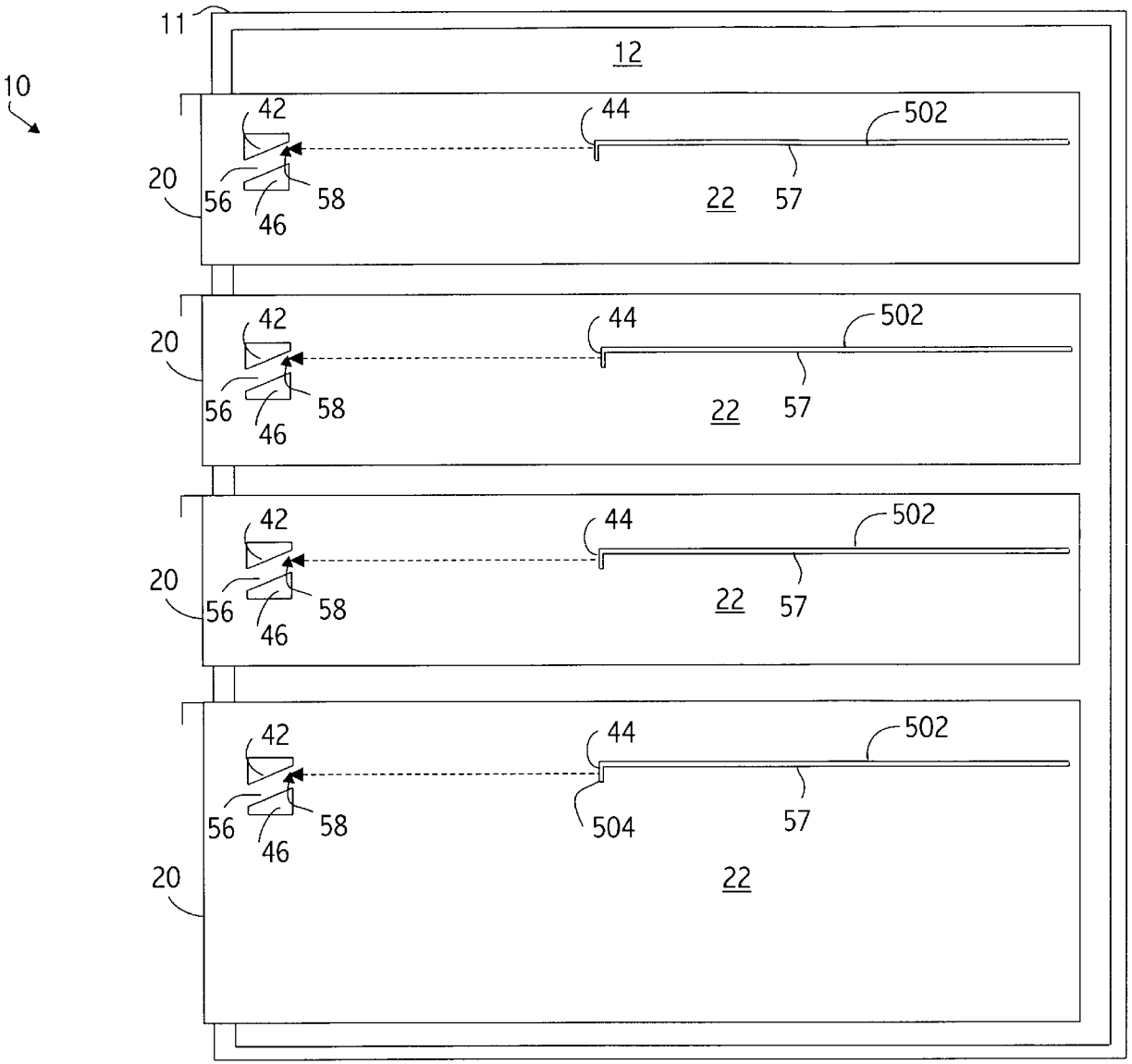
FIG. 5 is a side elevational view of a fifth form of multi-drawer device with its side wall removed.
Figure 5A:
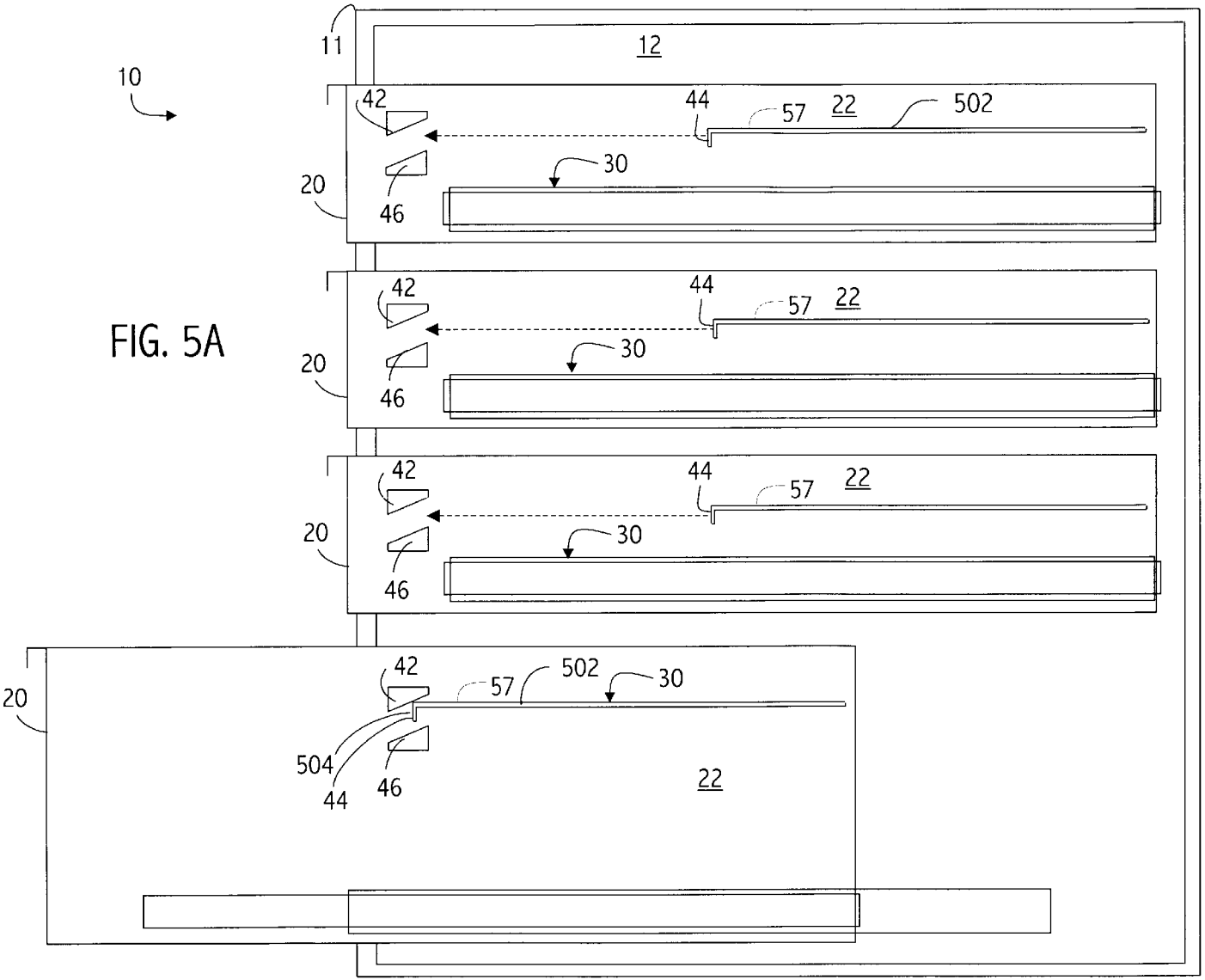
FIG. 5A is view similar to FIG. 5 with the bottom drawer extending just beyond a predetermined partially opened position.
Figure 5B:
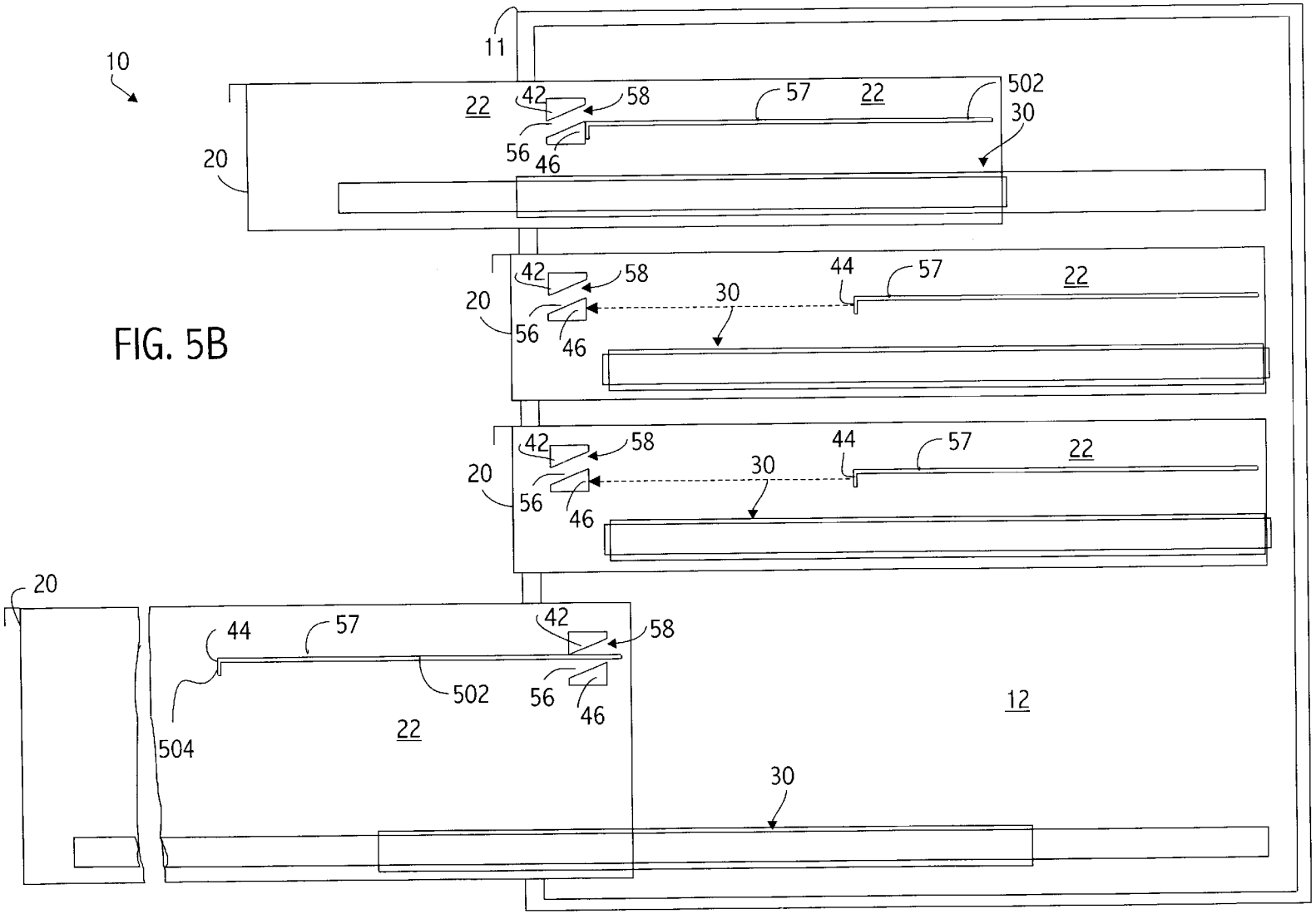
FIG. 5B is a view similar to FIG. 5 with the bottom drawer in a fully opened position and the top drawer in a predetermined partially opened position.
Figure 5C:
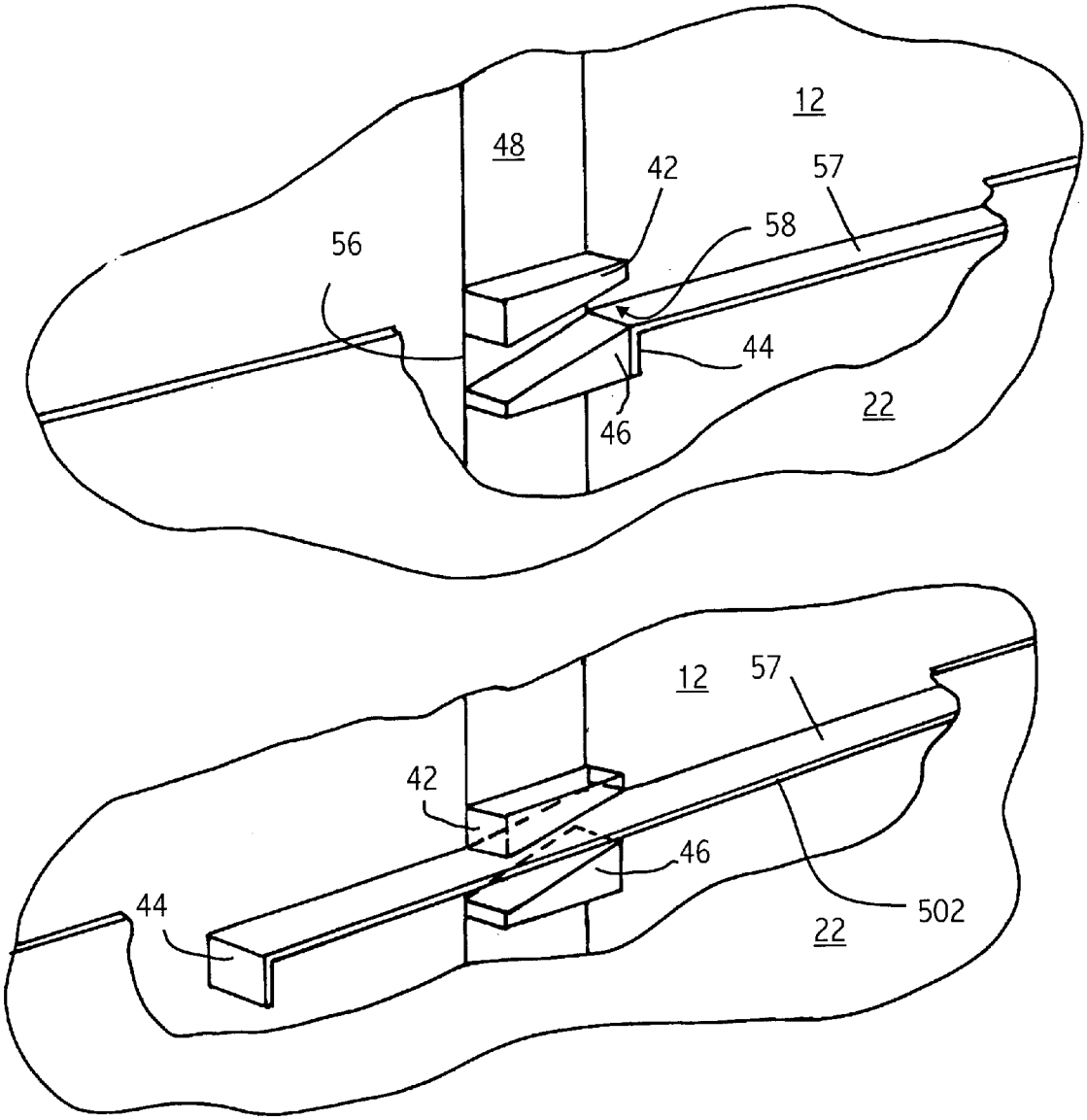
FIG. 5C is an enlarged, fragmentary, perspective view of a locking structure used in the multi-drawer device of FIG. 5.

Referring to FIGS. 5 and 5A–C, there is illustrated a second form of multi-drawer device. This form of multi-drawer device 10 is similar to the form depicted in FIGS. 1 and 1A–C, with several modifications. In this form, support 57 comprises a flange extending outward from drawer side wall 22. This flange may take the form of leg 502 of the L-shaped beam depicted in FIGS. 5 and 5A–C. Follower 44 is coupled to the end of support 57 nearest ramp 42 when drawer 20 is in the closed position, as shown in FIG. 5. In the example depicted, follower 44 is integral with support 57 and comprises the leg 504 of the L-shaped beam. While follower 44 is shown as extending perpendicular to rest of support 57 it could be curved or have any other suitable shape. In an alternate form, follower 44 is not integral with support 57. Instead, follower 44 is adjacent to support 57 and precedes it through guide 56 as drawer 20 is moved toward the fully open position.

Figure 2:
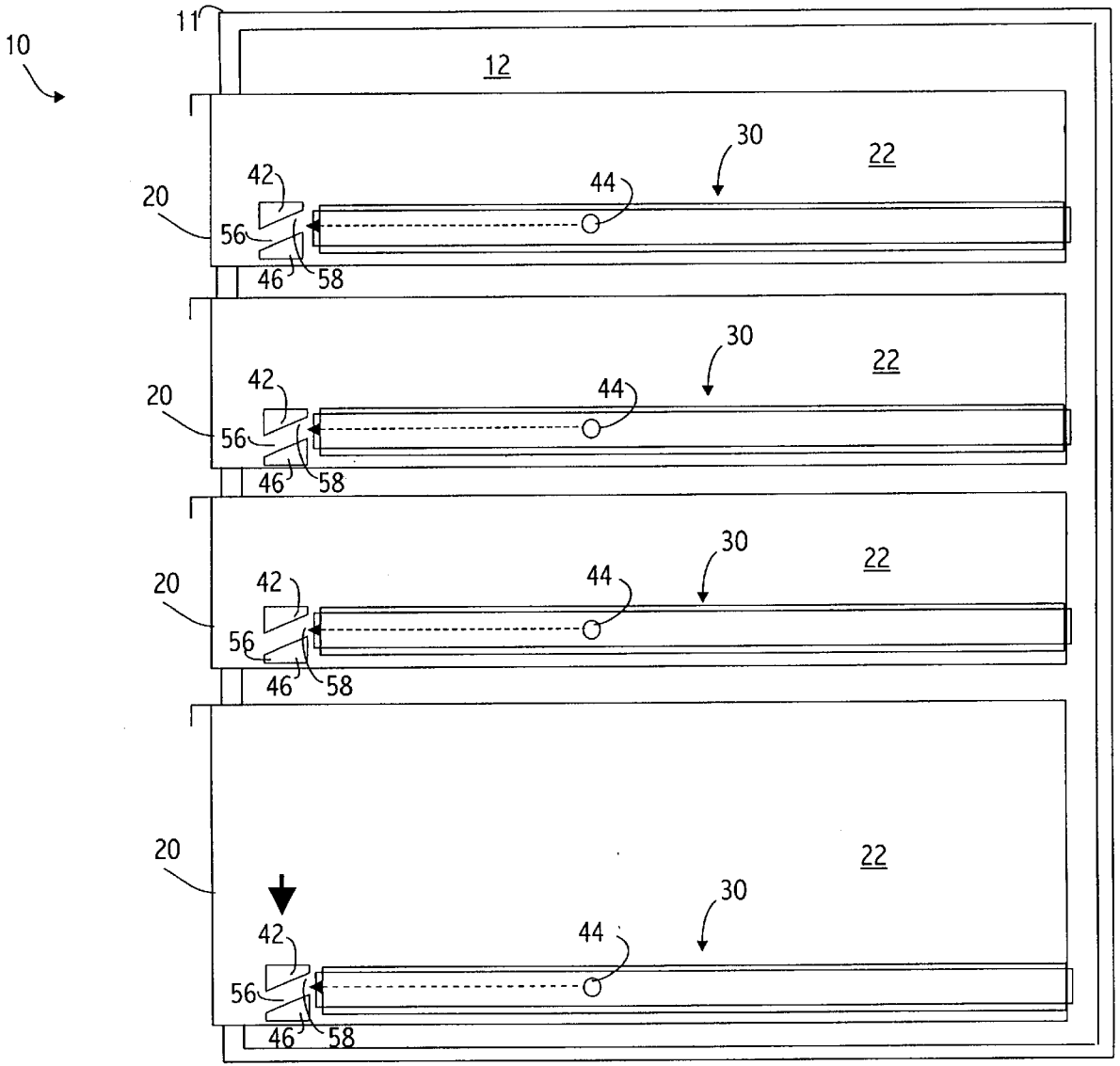
FIG. 2 is a side elevational view of a second form of multi-drawer device having one side wall removed.
Figure 2A:
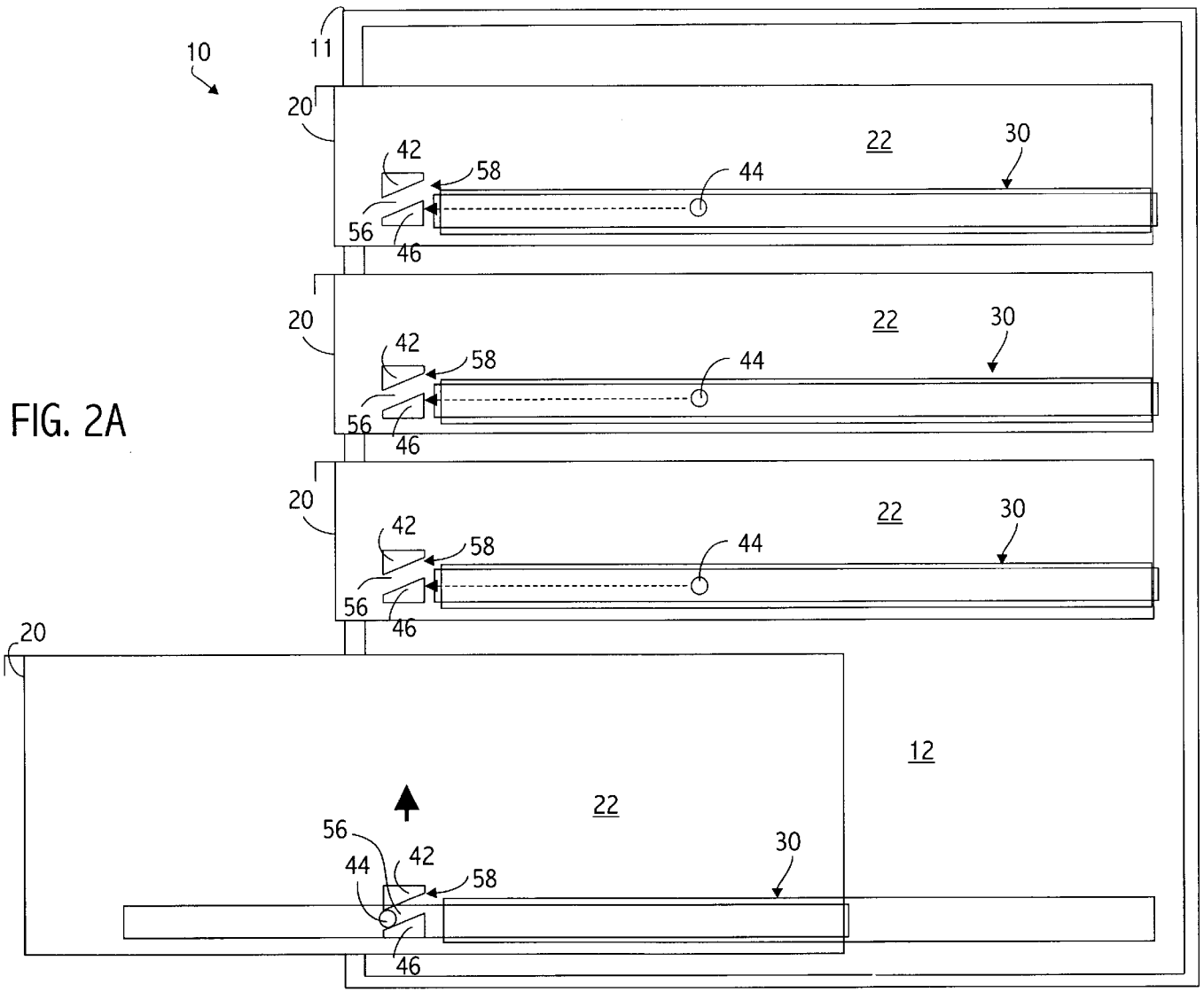
FIG. 2A is a view similar to FIG. 2 with the bottom drawer extending just beyond a predetermined partially opened position.
Figure 2B:
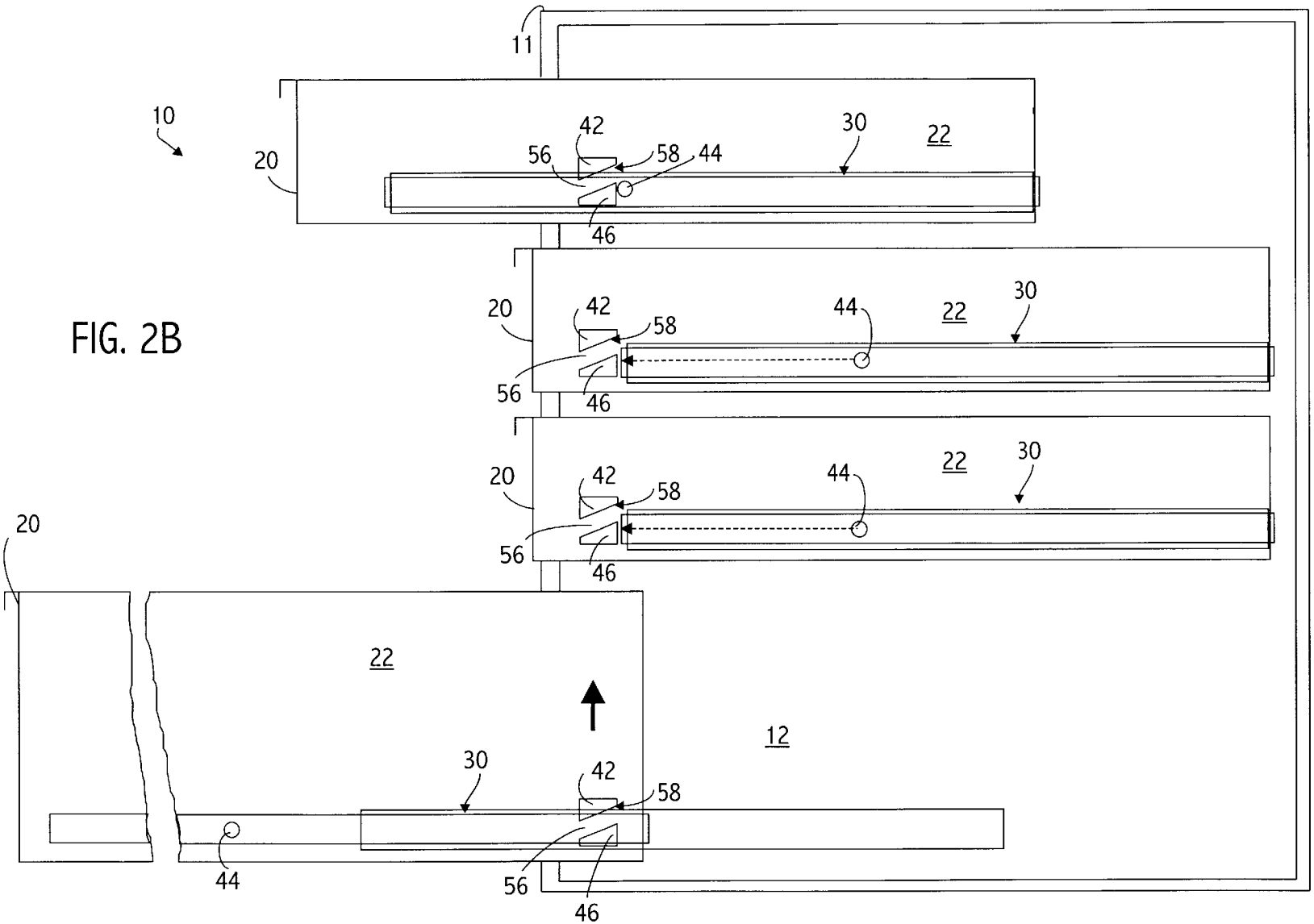
FIG. 2B is a view similar to FIG. 2 with the bottom drawer extended to a fully opened position and the top drawer in a predetermined partially opened position.

A third form of multi-drawer device 10 is depicted in FIGS. 2 and 2A–C. This form of multi-drawer device 10 is similar to the form depicted in FIGS. 1 and 1A–C, with several modifications. In this form, follower 44 is attached to, or part of, intermediate slide member 36 instead of to drawer side wall 22. In one form, follower 44 can be formed as part of intermediate slide member 36 and may be in the form of an elongated protrusion or a channel in intermediate slide member 36. A suitable support (not shown) can be provided to keep blocking device 46 in a blocked position, as shown in FIG. 2B. Alternatively, bar 48 (not shown) can be slidably coupled to side wall 12 such that the frictional force between bar 48 and side wall 12 supports bar 48 and blocking device 46 until the bar 48 is acted on by another force opposite the frictional force. In this manner, as one drawer 20 is moved to a predetermined partially opened position, as shown in FIG. 2A, bar 48, ramp 42, and blocking device 46 all rise and friction holds them up until drawer 20 is closed. Thereupon, follower 44 acts on blocking device 46 causing a downward force that overcomes the force of friction.

A fourth form of multi-drawer device is depicted in FIGS. 3 and 3A–C. This form is similar to the form depicted in FIGS. 1 and 1A–C, but with several modifications. In this form, follower 44 comprises the end of intermediate member 36 of slide mechanism 30 that is nearest ramp 42 when a drawer 20 is in a closed position (see FIG. 3). Blocking device 46 is movably coupled to bar 48, such that blocking device 46 can move vertically with respect to bar 48. Although blocking device 46 is described as moving vertically with respect to bar 48, blocking device 46 actually remains at approximately a constant position with respect to the rest of the cabinet and it is bar 48 that moves in the vertical direction. This can be accomplished, for example, by providing a horizontal elongated slot (not shown) in at least one of blocking device 46 and bar 48. Then blocking device 46 and bar 48 can be movably coupled together with a fastener that rides in the elongated slot. A spring (not shown), or other device, is utilized to bias blocking device 46 upwards with respect to bar 48.

Figure 3:
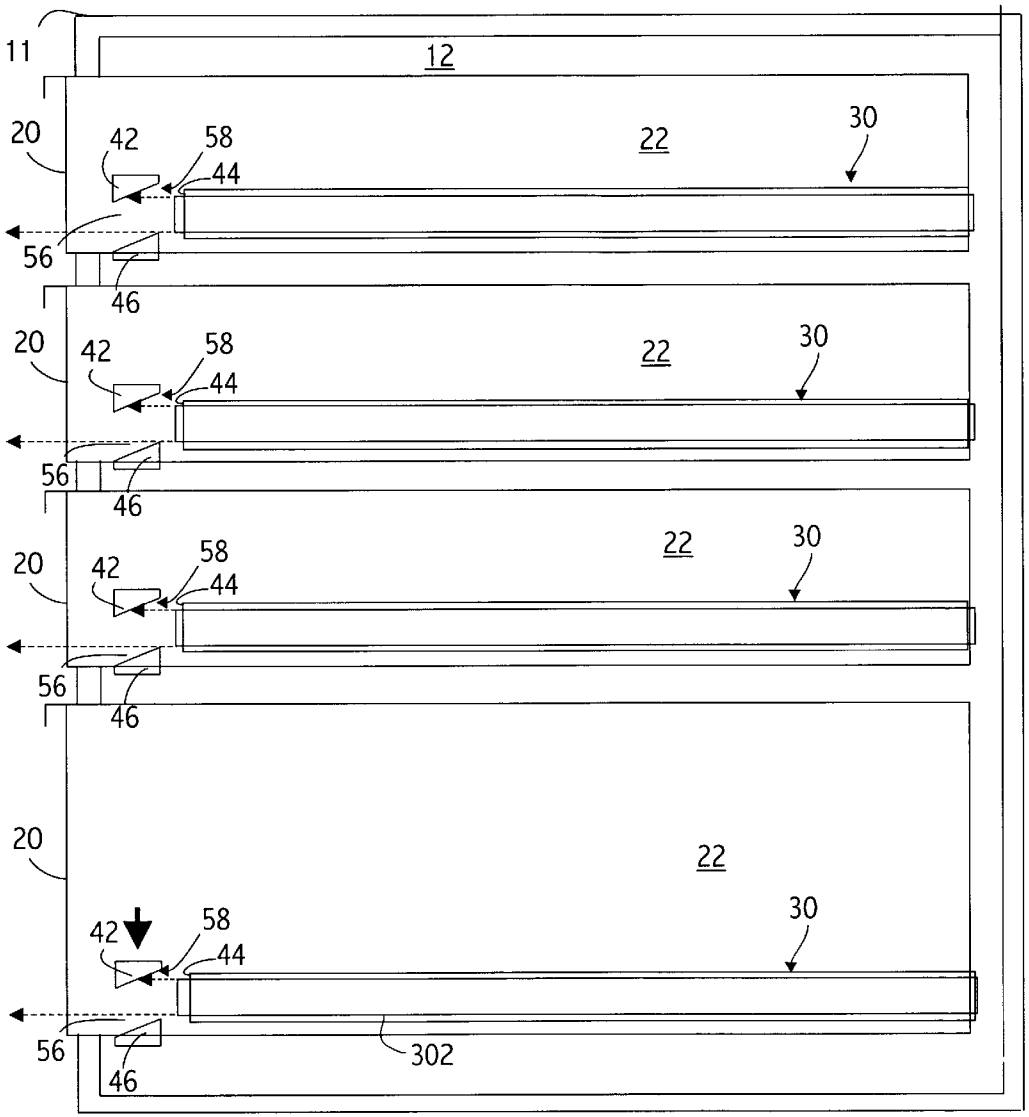
FIG. 3 is a side elevational view of a third form of a multi-drawer device having its side wall removed.
Figure 3A:
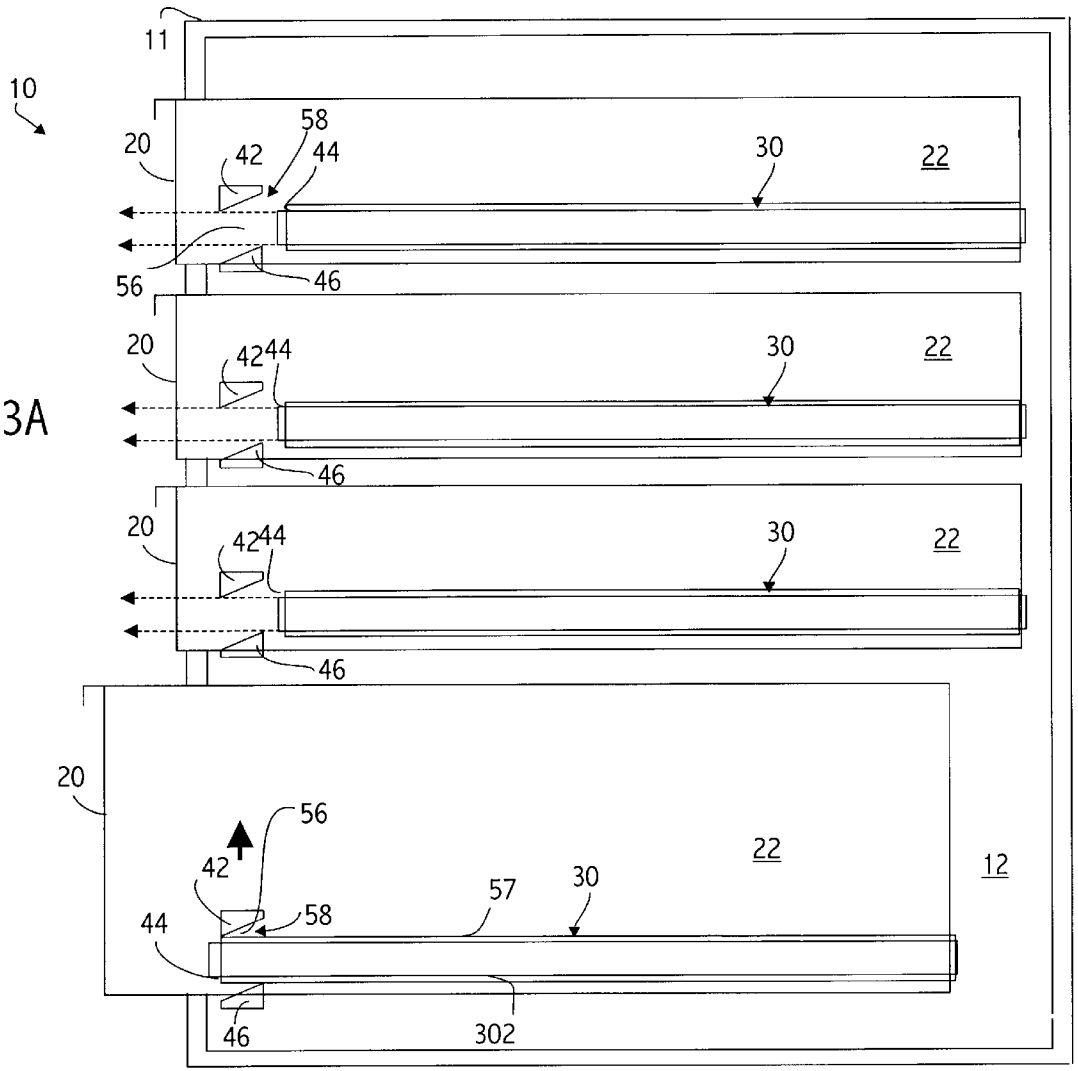
FIG. 3A is a view similar to FIG. 3 with the bottom drawer extended just beyond a predetermined partially opened position.
Figure 3B:
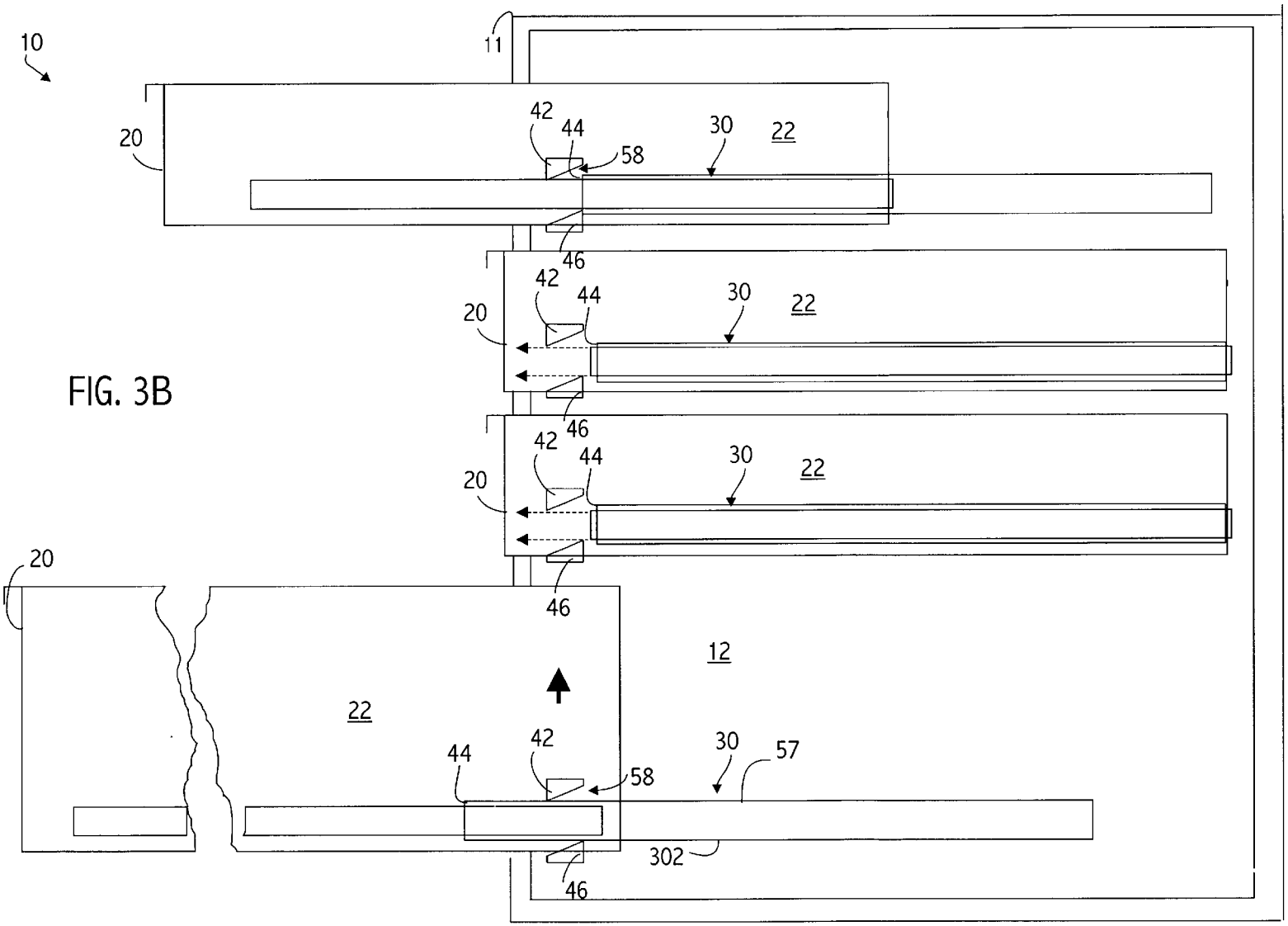
FIG. 3B is a view similar to FIG. 3 with the bottom drawer extended to a fully opened position and the top drawer in a predetermined in a partially opened position.
Figure 3C:
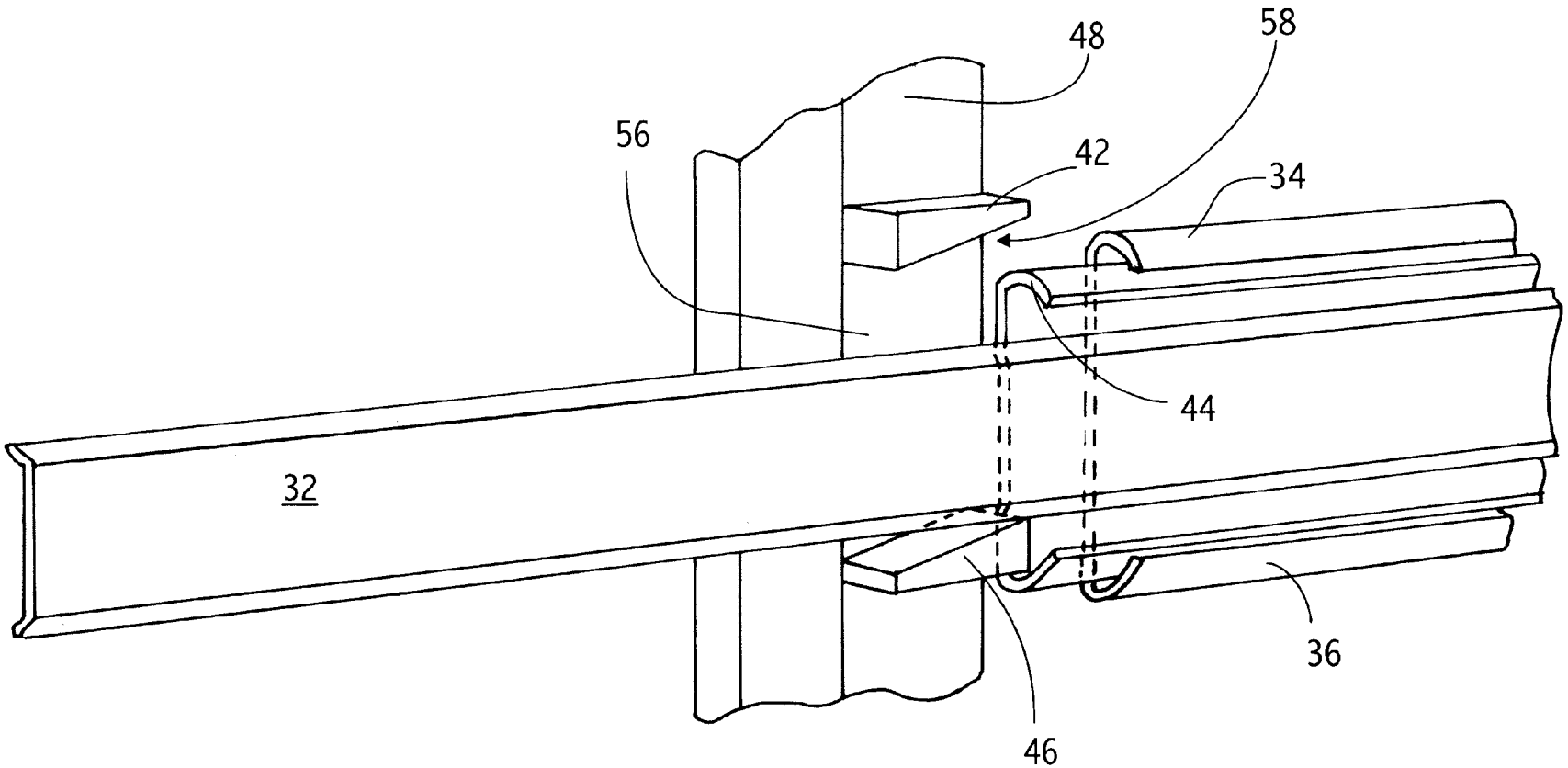
FIG. 3C is an enlarged, fragmentary, perspective view of a locking mechanism on the top drawer of the multi-drawer device of FIG. 3B.

In operation, follower 44 of intermediate member 36 moves within guide 56. As follower 44 contacts ramp 42, ramp 42 and bar 48 move upward while blocking device 46 is supported and retained by intermediate member 36 as shown in FIG. 3A. Essentially, follower 44 is the front edge of intermediate member 36, and the bottom edge 302 of intermediate member 36 retains the blocking device for the drawer that has been brought beyond a predetermined partially opened position. Since the rest of blocking devices 46 are biased upward with respect to the bar they will move along with the bar and interfere with intermediate member 36 when a second drawer moves to a predetermined partially opened position, as shown in FIG. 3B. In other words, support 57 supports and retains ramp 42, thereby keeping bar 48 and the blocking device 46, associated with the rest of drawers 20, in a blocking position.

A fifth form of multi-drawer device is shown in FIGS. 4 and 4A–4C. In this form, bar 48 is initially biased in an upward position and can use a spring (not shown), or other suitable device, to accomplish this. Like the fourth form, blocker 46 is movably coupled to bar 48. However, this time bar 46 is pivotally coupled to bar 48. In the depicted form, bar 48 includes a cut out portion, such as opening 47, in which blocking device 46 is movable within. Like some previously described forms, follower 44 comprises the front end of intermediate member 36 of slide assembly 30.

Figure 4:
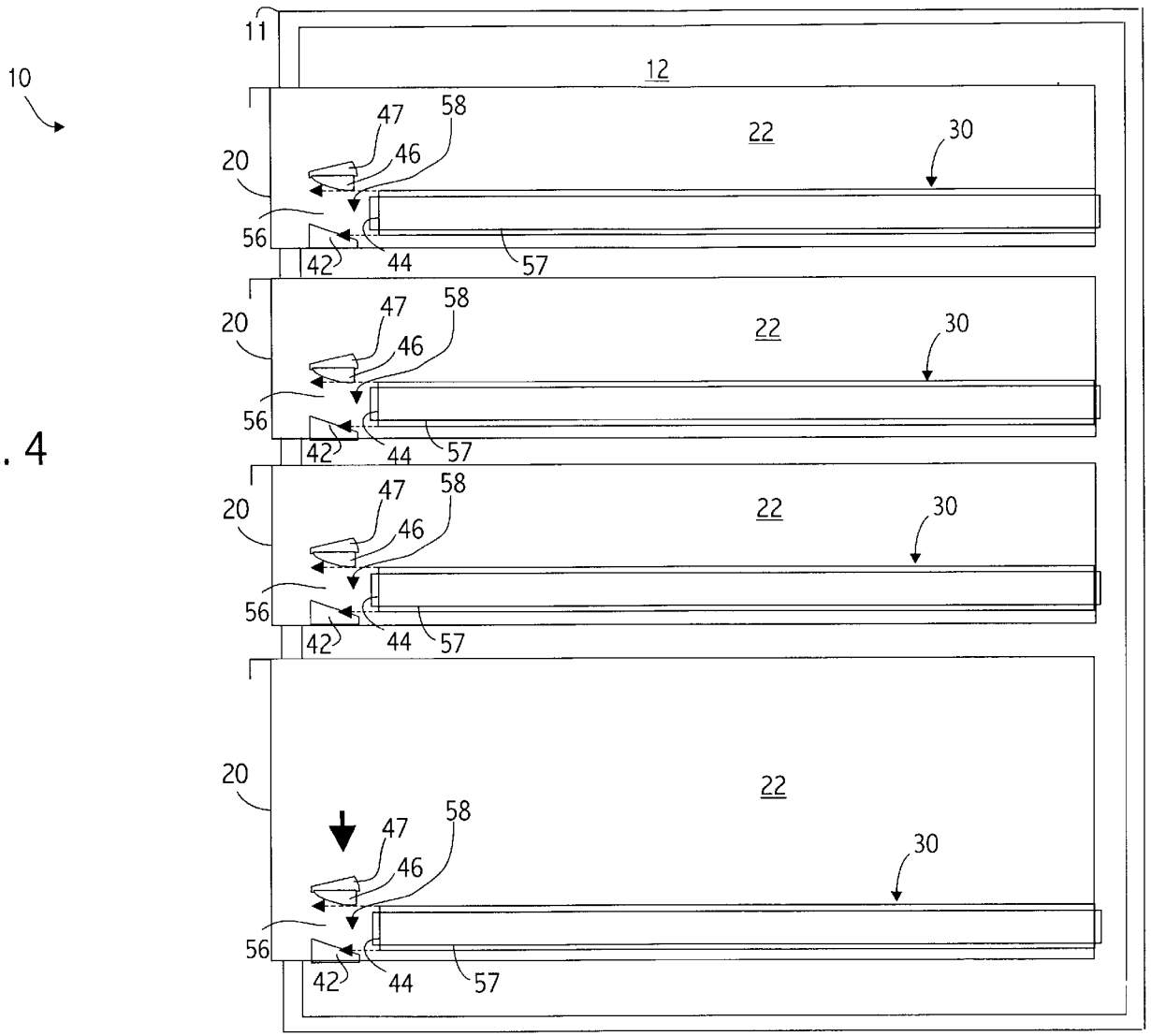
FIG. 4 is a side elevational view of a fourth form of a multi-drawer device having a side wall removed.
Figure 4A:
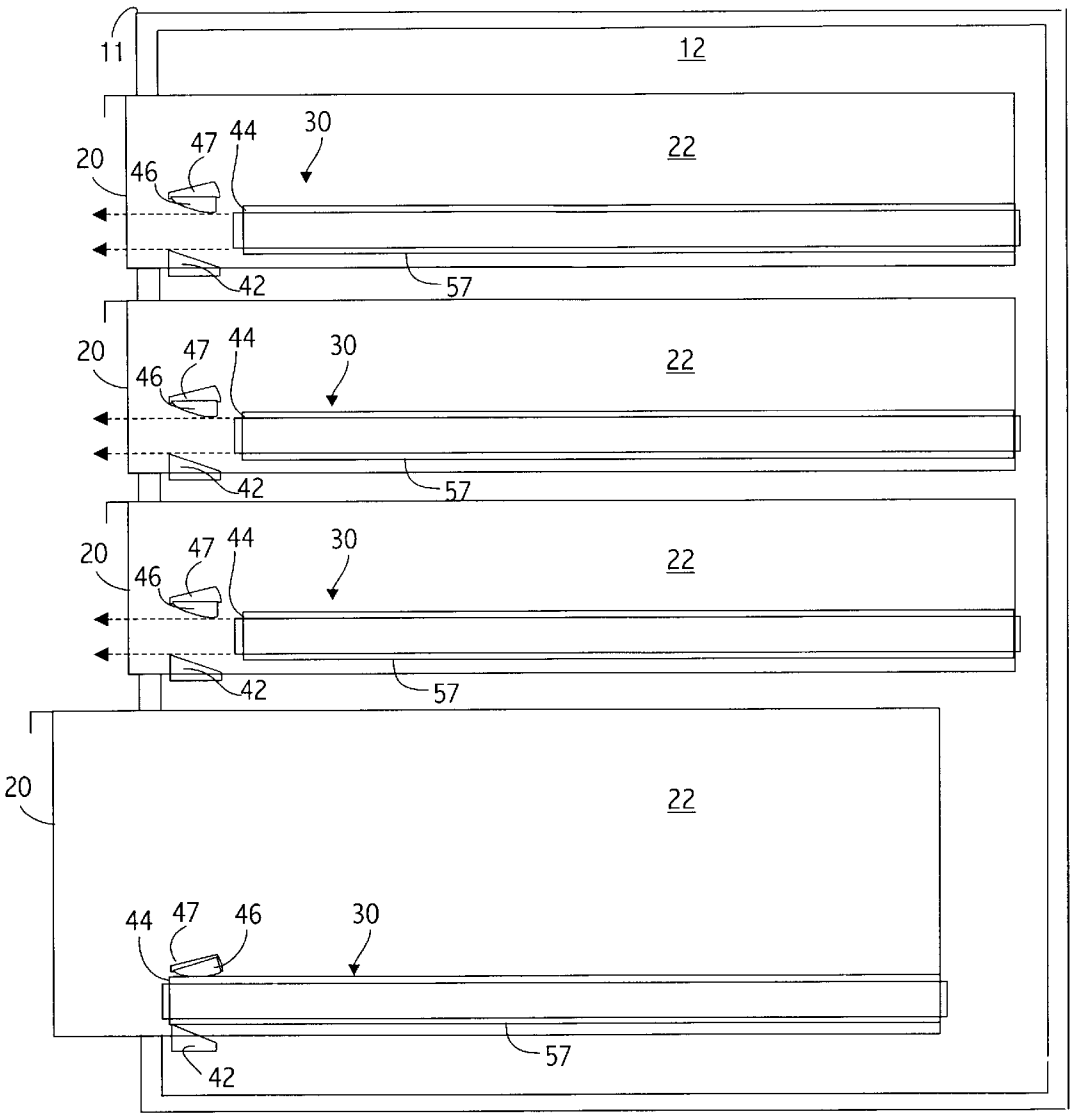
FIG. 4A is view similar to FIG. 4 with the bottom drawer extending open just beyond a predetermined partially opened position.
Figure 4B:
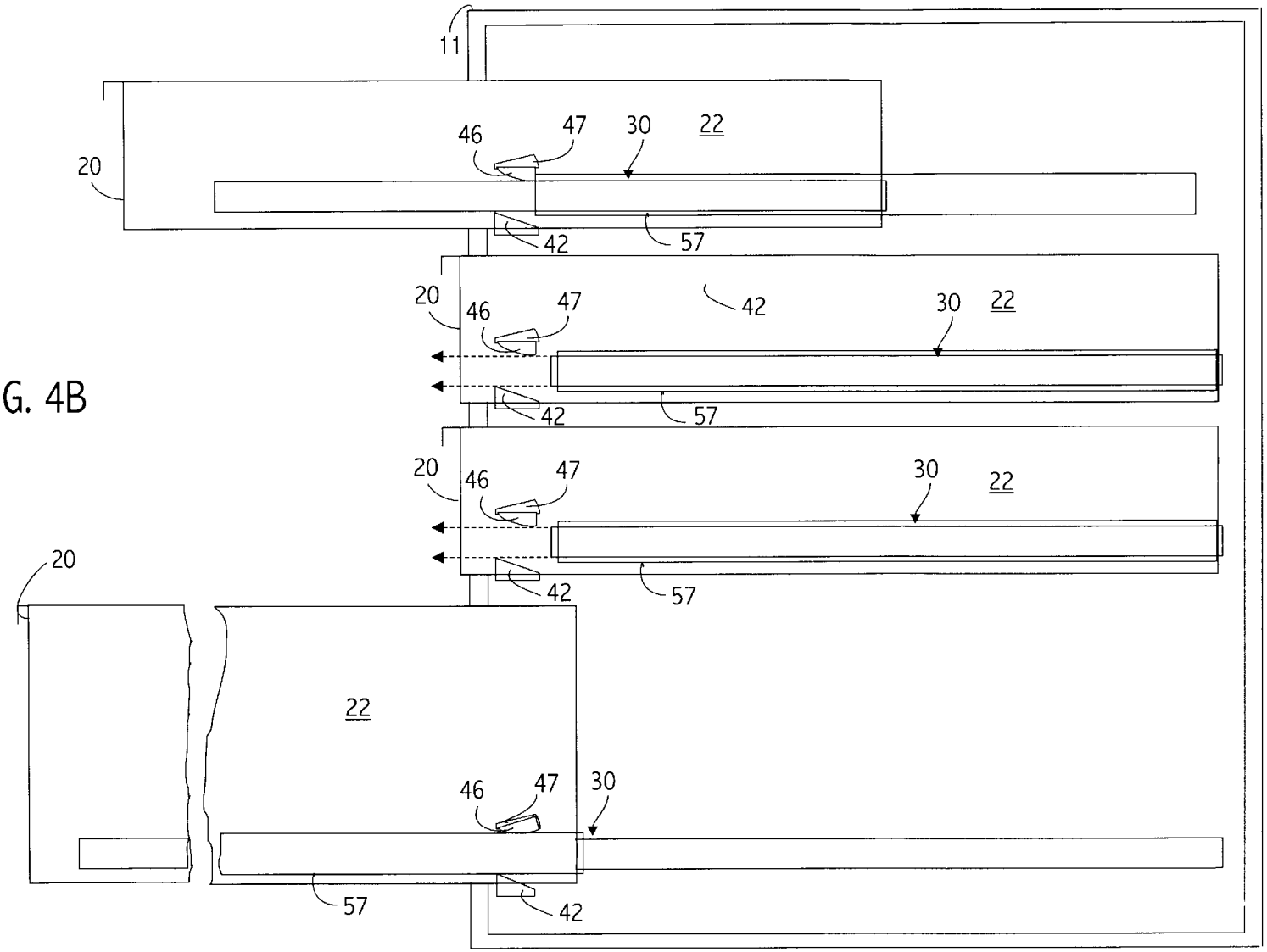
FIG. 4B is a view similar to FIG. 4 with the bottom drawer in a fully opened position and the top drawer in a predetermined partially opened position.
Figure 4C:
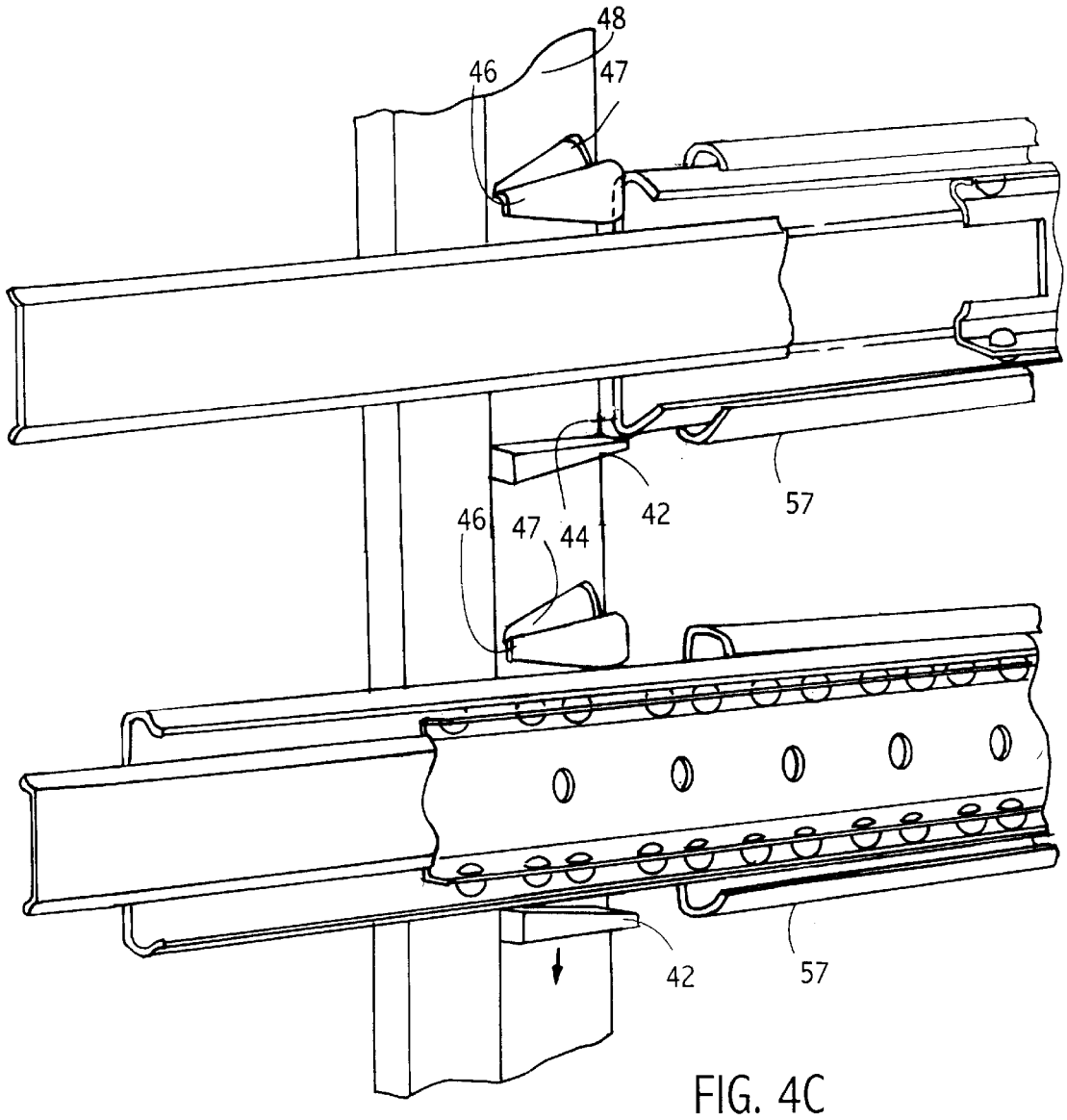
FIG. 4C is an enlarged, fragmentary, perspective view of a locking mechanism of the multi-drawer device of FIG. 4.

In use, as drawer 20 is moved toward the fully opened position (shown in FIG. 4B) and reaches the predetermined partially opened position, follower 44 enters guide 46 and blocking device 46 rests on intermediate member 36. Follower 44 contacts ramp 42, causing ramp 42 and bar 48, along with the ramps 42 and blocking devices 46 associated with the still closed drawers, to move downward. Meanwhile, the blocking device 46, that is associated with the drawer 20 being opened, moves into opening 47. Ramp 42 is supported and retained by the bottom edge, or support 57, of intermediate member 36. As a second drawer is opened and reaches the predetermined partially opened position, blocker 46 associated with such drawer 20 interferes with intermediate member 36 of slide assembly 30 and prevents the partially opened drawer 20 from moving to a fully opened position, as shown in FIG. 4B.

A sixth form of a multi-drawer device is disclosed in FIGS. 6 and 7. This form is similar to the fifth form, but has several modifications. In this form, cut out 47 is on one exterior edge of bar 48 and a second cut out 49 is provided on the opposite edge to allow a hinged connection between blocking device 46 and bar 48. As first drawer is opened towards a fully opened position, follower 44 enters guide 46 underneath blocking device 46 and contacts ramp 42. As follower 44 slides along ramp 42, blocking device 46 rests on intermediate member 36 and ramp 42 and bar 48 move downward, thereby moving bar 48 ramp 42 and the ramps 42 and blocking devices 46 associated with the still closed drawers. Support 57 is comprised of sliding mechanism 30 and holds and retains ramp 42 down to keep the blocking devices 46 associated with the rest of drawers 20 in the blocked position. As previously mentioned, an elongated slot can be used to couple bar 48 to slide wall 12 of multi-drawer device. In one form, such elongated slot is provided at an angle to the vertical movement of the bar. This allows for easier movement of bar 48 as follower 44 contacts the angled ramp 42.

Several different forms of multi-drawer device have been disclosed. However, the above forms have numerous variations. For example, follower 44 can be a lanced out protrusion of drawer 20 that is sized to fit within guide 56. In another form, follower 44 or guide 56 can include a reduced friction device, such as a pin having a plastic sleeve, coating or film, such as one made from a TFE fluorocarbon polymer, such as Teflon™, that would reduce the friction of the follower 44 moving through guide 56 and along ramp 42. In another form, follower 44 can comprise a pin surrounded by a friction reducing roller bearing. Ramp 42, blocking device 46 and bar 48 can be machined, or otherwise formed, from any suitable material. Likewise, ramp 42, blocking device 46 and bar 48 can be molded from plastic and can even be machined or molded as one integral unit.

As previously discussed, follower 44 can comprise a pin that extends from drawer side wall 22, as shown in FIG. 1*c*. In one form, such pin can be removably coupled to drawer side wall 22, such as through the use of a threaded fastener like a screw or bolt that fastens such pin to drawer side wall 22. In one form, multiple apertures could be provided along drawer side wall 22, such as along the dotted lines shown in FIG. 1, so that the manufacturer, seller or end user can easily custom modify the locking features of the drawer by providing the pin at whatever location is desired.

From the foregoing, it can be seen that there has been provided an improved multi-drawer device having a drawer locking assembly that is configured to prevent more than one drawer from being moved to a fully open position at the same time.

We claim:

1. A multi-drawer device comprising:

a housing;

a first drawer and a second drawer, each carried by the housing and movable between a closed position disposed within the housing and a fully open position extending a maximum distance from the housing;

a ramp associated with the first drawer;

a first follower associated with the first drawer and adapted to contact and slide along the ramp; and a first blocking device coupled to one of the ramp and the follower and associated with the second drawer;

wherein the ramp, the first follower and the first blocking device all cooperate such that as the first drawer moves from the closed position toward the fully open position, the first follower contacts and slides along the ramp, for moving the first blocking device into a blocked position that interferes with the second drawer when the second drawer is in a predetermined partially open position, thereby preventing the second drawer from moving to the fully open position while still providing access to the second drawer.

2. The multi-drawer device of claim 1, further comprising a bar coupling the ramp and the first blocking device together.

3. The multi-drawer device of claim 2, further comprising a first support assembly adapted to retain the first blocking device in the blocked position as the first drawer moves toward the fully open position.

4. The multi-drawer device of claim 3, wherein the first support assembly comprises an elongated flange coupled to one of a sidewall of the first drawer and a housing sidewall.

5. The multi-drawer device of claim 4, wherein the first support assembly is coupled to the first drawer sidewall and comprises the first follower.

6. The multi-drawer device of claim 4, wherein the first support assembly comprises a beam coupled to the first drawer sidewall, the beam having an L-shaped cross-section.

7. The multi-drawer device of claim 4, further comprising a first slide assembly coupling the first drawer to the housing and a second slide assembly coupling the second drawer to the housing, wherein the first support assembly comprises the first slide assembly.

8. The multi-drawer device of claim 7, wherein the first slide assembly includes the first follower.

9. The multi-drawer device of claim 8, wherein the first slide assembly is a three-piece telescoping slide assembly having an intermediate member comprising the first follower.

10. The multi-drawer device of claim 7, wherein the first blocking device in the blocked position interferes with the second slide assembly.

11. The multi-drawer device of claim 4, wherein the first blocking device moves with respect to the bar.

12. The multi-drawer device of claim 11, wherein the first blocking device is pivotally coupled to the bar.

13. The multi-drawer device of claim 11, wherein the bar has a cutout portion and the first blocking device moves within the cutout portion.

14. The multi-drawer device of claim 13, wherein the cutout portion is an opening.

15. The multi-drawer device of claim 3, further comprising a second support assembly associated with the second drawer, wherein the first blocking device interferes with the second support assembly.

16. The multi-drawer device of claim 3, wherein the first follower is adapted to contact and slide along the ramp when the first drawer is in the predetermined partially open position.

17. The multi-drawer device of claim 2, wherein the housing has at least one wall and the bar is slidably coupled to, and frictionally engageable with, the one wall such that the bar is slidable upward and downward with respect to the one wall and remains in the upward position until further acted upon.

18. The multi-drawer device of claim 1, further comprising a second follower associated with the second drawer, wherein the first blocking device in the blocked position interferes with the second follower.

19. A method of preventing a second drawer from moving to a fully open position when a first drawer is opened in a device having plural drawers, the method comprising:

positioning a blocker so as to be responsive to movement of a first drawer toward a fully open position to interfere with a second drawer in a blocking manner when the second drawer is in a predetermined partially open position; and retaining the blocker with a first support device associated with the first drawer in a blocking position that interferes with the second drawer in the predetermined partially open position, thereby preventing the second drawer from moving to the fully open position while still providing access to the second drawer.

20. The method of claim 19, wherein a first slide assembly is coupled to the first drawer and retains the blocker in the blocking position.

21. The method of claim 20, wherein the blocker interferes with a second slide assembly coupled to the second drawer when the blocker is in the blocking position.

22. The method of claim 19, wherein the blocker interferes with a second support device associated with the second drawer, when the blocker is in the blocking position.

23. The method of claim 19, further comprising:

providing a ramp and a first follower associated with a first drawer;

providing a second follower coupled to a second drawer;

moving the first drawer from the closed position toward the fully open position; and sliding the first follower along the ramp and causing the blocker to move;

wherein interfering with the second drawer comprises positioning the blocker to interfere with the second follower.

24. The method of claim 19, further comprising providing a slide assembly coupled to the second drawer and wherein interfering with the second drawer comprises positioning the blocker to interfere with the slide assembly.

* * * * *